US009136616B2

(12) United States Patent
Zhao et al.

(10) Patent No.: US 9,136,616 B2
(45) Date of Patent: Sep. 15, 2015

(54) ELECTRICAL CONNECTOR ASSEMBLY WITH IMPROVED METALLIC COVER

(71) Applicant: HON HAI PRECISION INDUSTRY CO., LTD., New Taipei (TW)

(72) Inventors: Jun Zhao, Kunshan (CN); Jing-Jie Guo, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/243,130

(22) Filed: Apr. 2, 2014

(65) Prior Publication Data

US 2014/0295689 A1 Oct. 2, 2014

(30) Foreign Application Priority Data

Apr. 2, 2013 (CN) ..... 2013 2 01588083 U

(51) Int. Cl.

| | |
|---|---|
| ***H01R 13/62*** | (2006.01) |
| ***H01R 9/24*** | (2006.01) |
| ***H01R 12/72*** | (2011.01) |
| ***H01R 13/516*** | (2006.01) |
| ***H01R 13/52*** | (2006.01) |
| *H01R 13/24* | (2006.01) |

(52) U.S. Cl.

CPC ..... *H01R 9/2408* (2013.01); *H01R 12/724* (2013.01); *H01R 13/516* (2013.01); *H01R 13/5202* (2013.01); *H01R 13/5219* (2013.01); *H01R 13/2442* (2013.01); *Y10T 29/49208* (2015.01)

(58) Field of Classification Search

CPC ..... H01R 13/516; H01R 9/2408

See application file for complete search history.

(56) References Cited

U.S. PATENT DOCUMENTS

| | | | | |
|---|---|---|---|---|
| 4,482,200 | A * | 11/1984 | Willenborg | 439/460 |
| 5,797,771 | A * | 8/1998 | Garside | 439/607.46 |
| 6,665,189 | B1 * | 12/2003 | Lebo | 361/730 |
| 7,101,225 | B2 * | 9/2006 | Kohler | 439/607.23 |
| 8,801,463 | B2 * | 8/2014 | Tan et al. | 439/607.04 |
| 2002/0119697 | A1 | 8/2002 | Chan | |
| 2004/0248467 | A1 * | 12/2004 | Herlitz et al. | 439/607 |
| 2010/0136847 | A1 * | 6/2010 | Hung et al. | 439/701 |
| 2012/0315779 | A1 | 12/2012 | Yudate et al. | |
| 2013/0084747 | A1 * | 4/2013 | Dendas et al. | 439/607.41 |
| 2014/0073190 | A1 * | 3/2014 | Zhao et al. | 439/626 |
| 2014/0295689 | A1 * | 10/2014 | Zhao et al. | 439/271 |

FOREIGN PATENT DOCUMENTS

| | | |
|---|---|---|
| TW | M385114 | 7/2010 |
| TW | M469655 | 1/2014 |

* cited by examiner

*Primary Examiner* — James Harvey

(74) *Attorney, Agent, or Firm* — Ming Chieh Chang; Wei Te Chung

(57) ABSTRACT

An electrical connector assembly (100) includes a securing box (3) and a electrical connector (2). The securing box (3) includes a box portion (31) for receiving the electrical connector (2). The electrical connector (2) includes an insulative housing (20), a number of terminals (21) retained in the insulative housing (20) and a metallic cover (22) covering the insulative housing (20). The metallic cover (22) includes a pair of cantilever arm (225) extending forwardly and outwardly from two sides thereof. The box portion (31) includes corresponding an extraction slot (317) and a locating slot (314) for receiving the cantilever arm (225), the extraction slot is used to remove the electrical connector by a tool inserted thereof and therefore, the electrical connector (100) can be easily assembled or replaced from an electronic equipment.

20 Claims, 9 Drawing Sheets

ELECTRICAL CONNECTOR ASSEMBLY WITH IMPROVED METALLIC COVER

BACKGROUND OF THE INVENTION

1. Field of the Invention

The present invention relates generally to an electrical connector assembly, and more particularly to an electrical connector assembly to be easily assembled on a printed circuit board (PCB) and/or replaced from the PCB.

2. Description of Related Arts

Universal Serial Bus (USB) interfaces are widely used in various electronic devices. In recent years, a micro USB interface is introduced to meet miniaturization requirement of electronic devices. Taiwan Utility Model No. M385114 discloses an electrical connector comprising an insulative cover and a connecting module. The insulative cover includes an upper surface, a lower surface faced to the upper surface, and a pair of side surfaces for cooperatively defining a receiving room. The receiving room has a contacting opening for insertion of a plug connector. The upper surface faces a PCB. The connecting module is received in the receiving room. The connecting module includes an insulative housing, a number of contact terminals, and a grounding contact. The contact terminals and the grounding contact are all fixed with the insulative housing by insert-molding. Each of the contact terminals and the grounding contact has a contacting part flexibly connecting with the PCB without soldering. The connecting module can be separated from the insulative cover, but the electrical connector is difficult to be assembled on the PCB and thus difficult to be replaced.

An electrical connector assembly that can be assembled on the PCB easily and replaced from the PCB easily is desired.

SUMMARY OF THE INVENTION

Accordingly, an object of the present invention is to provide an electrical connector assembly with an improved metallic cover for easily being assembled on the PCB and replaced from the PCB.

To achieve the above object, an electrical connector assembly includes a securing box and a electrical connector. The securing box includes a box portion for receiving the electrical connector. The electrical connector includes an insulative housing, a number of terminals retained in the insulative housing and a metallic cover covering the insulative housing. The metallic cover includes a pair of cantilever arm extending forwardly and outwardly from two sides thereof. The box portion includes corresponding an extraction slot and a locating slot for receiving the cantilever arm, the extraction slot is used to remove the electrical connector by a tool inserted thereof and therefore, and therefore, the electrical connector can be easily assembled or replaced from an electronic equipment.

Other objects, advantages and novel features of the invention will become more apparent from the following detailed description when taken in conjunction with the accompanying drawings.

DETAILED DESCRIPTION OF THE PREFERRED EMBODIMENT

Figure 1:
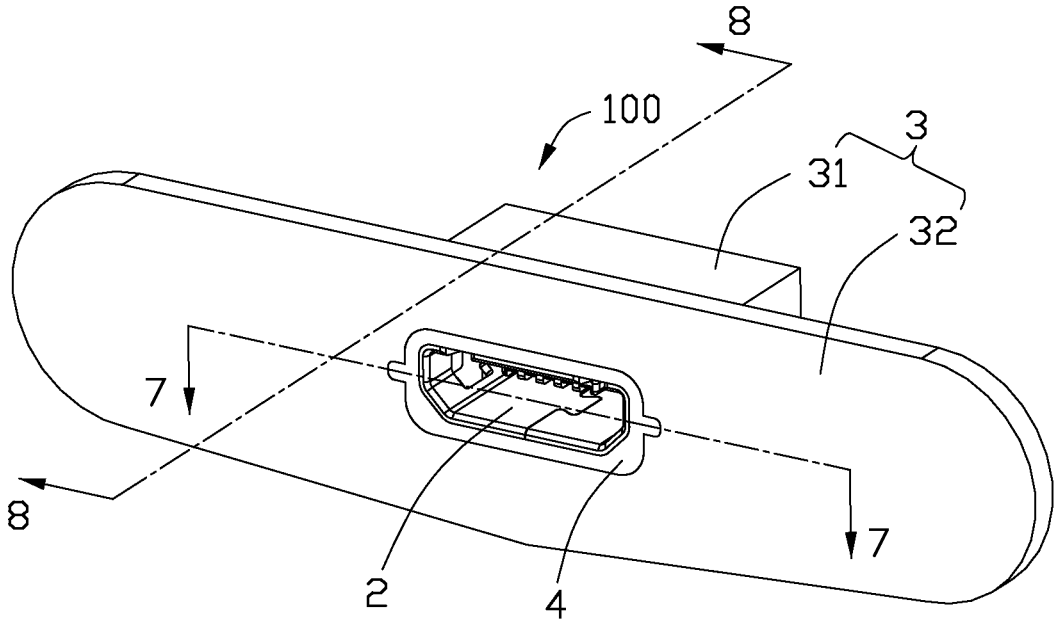
FIG. 1 is a perspective, assembled view of an electrical connector assembly of the present invention.
Figure 2:
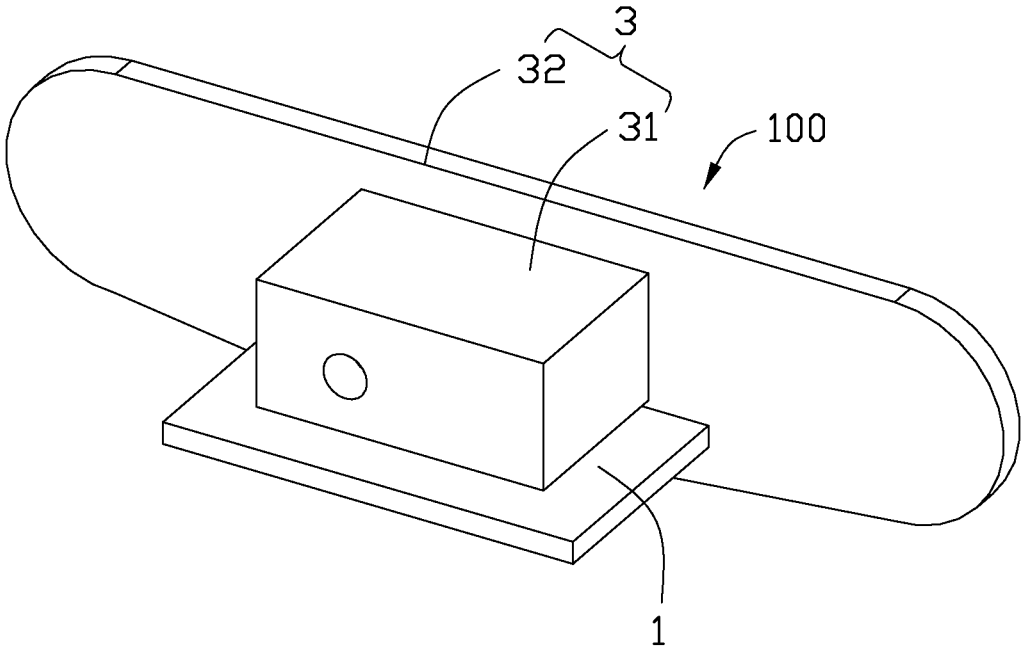
FIG. 2 is another perspective, assembled view of the electrical connector assembly but taken a different view with respect to FIG. 1.
Figure 3:
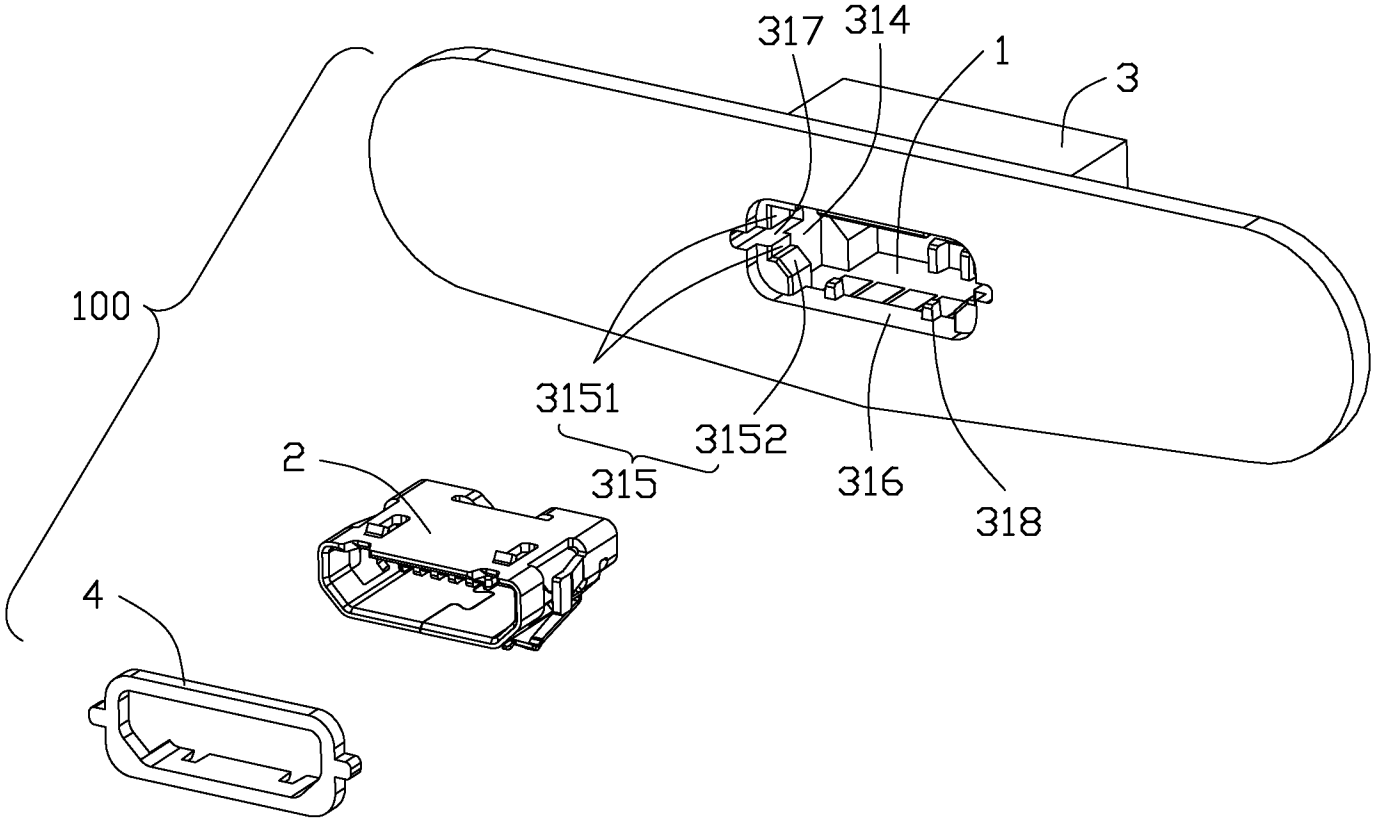
FIG. 3 is a perspective, partly exploded view of the electrical connector assembly taken a same view as FIG. 1, showing an electrical connector and a sealing ring separated from an securing box.

Reference will now be made in detail to the preferred embodiment of the present invention.

Referring to FIGS. 1 to 9, an electrical connector assembly 100 of the present invention comprises an electrical connector 2, a securing box 3 for receiving the electrical connector 2, a sealing ring 4 assembled between the electrical connector 2 and the securing box 3 at a front end of the electrical connector 2, a PCB 1 contacted with the electrical connector 2, and a waterproof ring 5 assembled between the electrical connector 2 and the PCB 1.

Figure 6:
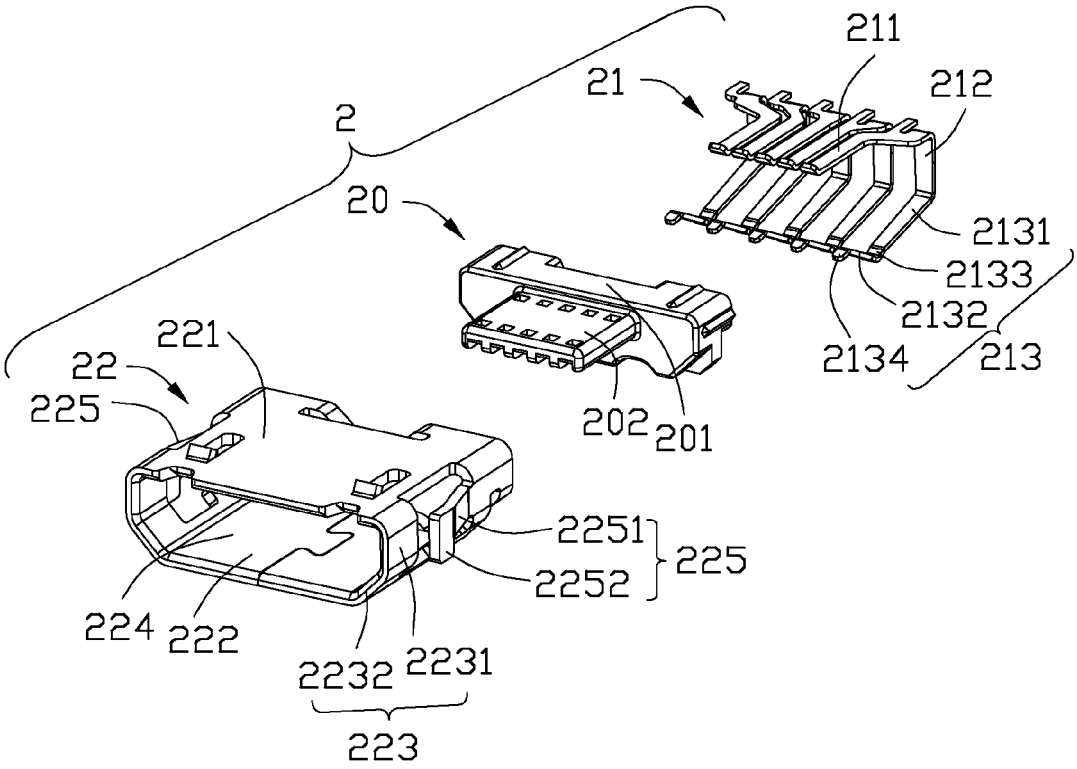
FIG. 6 is a perspective, exploded view of the electrical connector of the present invention.

Referring to FIG. 6, the electrical connector 2 comprises an insulative housing 20, a plurality of terminals 21 fixed with the insulative housing 20 by insert-molding, and a metallic cover 22 covering the insulative housing 20. The insulative housing 20 comprises a base portion 201 and a tongue portion 202 extending from the base portion 201. According to the illustrated embodiments of the present disclosure, the terminals 21 flexibly contact with the PCB 1 without soldering.

Referring to FIG. 6, each terminal 21 comprises a connecting portion 211 fixed in the tongue portion 202, a retaining portion 212 extending from the connecting portion 211 and fixed in the base portion 201, and a resilient portion 213 extending from the connecting portion 211 and out of the insulative housing 20 for flexibly connecting with the PCB 1. The connecting portion 211 is exposed on the tongue portion 202 for connecting with a mating connector (not shown). The resilient portion 213 is faced to the connecting portion 211 and substantially V-shaped. The resilient portion 213 includes a flat shaped first elastic arm 2131, a flat shaped second elastic arm 2132, and a connecting portion 2133 connecting with the first elastic arm 2131 and the second elastic arm 2132. The second elastic arm 2132 defines an end portion 2134 at front end thereof. The connecting portion 2133 flexibly connects with the PCB 1 without soldering.

Referring to FIG. 6, the metallic cover 22 comprises a top plate 221, a bottom plate 222, and a pair of lateral plates 223 connecting with the top plate 221 and the bottom plate 222 for cooperatively defining a receiving room 224 in which a mating connector is inserted along a mating direction. Each lateral plate 223 forms a cantilever arm 225. The cantilever arm 225 includes a resilient arm 2251 extending forwardly and outwardly from the lateral plate 223 and a resisting portion 2252 extending forwardly from the resilient arm 2251. The resisting portion 2252 is higher than the resilient arm 2251 along a first direction perpendicular to the top plate 221. In accordance with the embodiments of the present disclosure, the electrical connector 2 is a Micro USB socket. Each lateral plate 223 includes an inclined plate 2232 and a vertical plate 2231 extending upwardly from the inclined plate 2232. The vertical plate 2231 is perpendicular to the top plate 221 and the resisting portion 2252 is essentially parallel to the vertical plate 2231.

Figure 4:
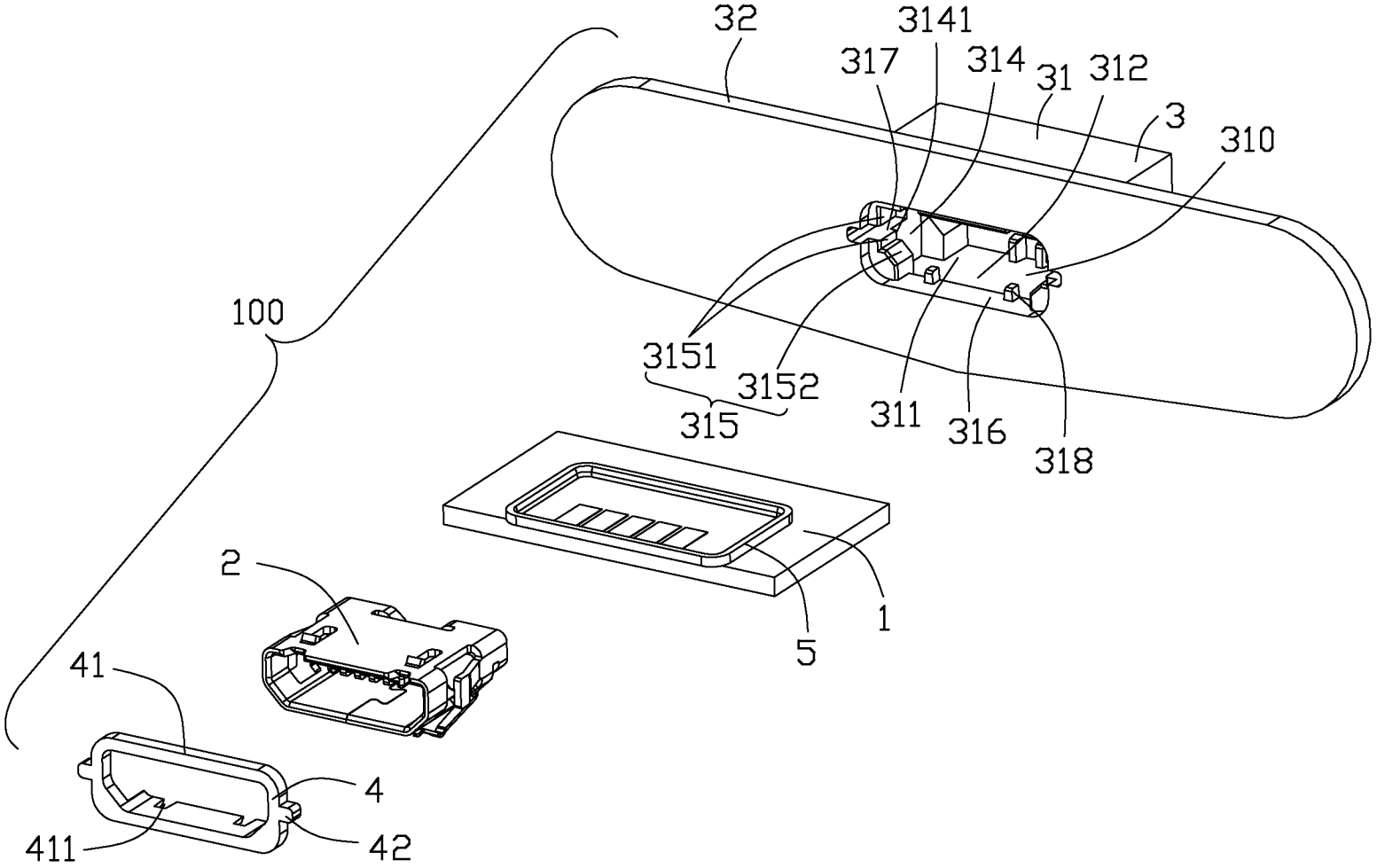
FIG. 4 is a perspective, further partly exploded view of the electrical connector assembly as shown in FIG. 3 with a waterproof ring and a PCB separated from the securing box.
Figure 7:
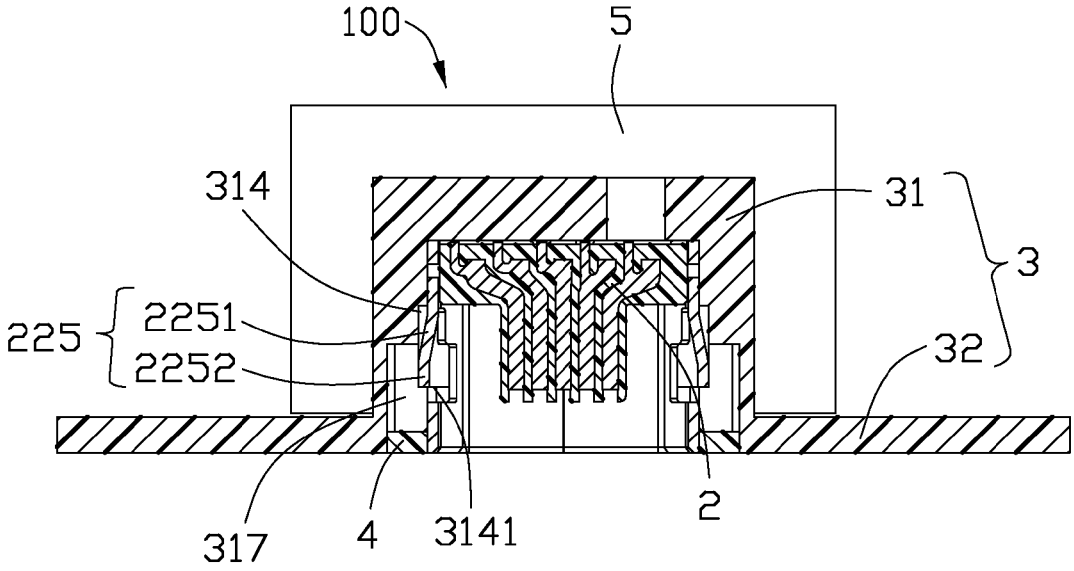
FIG. 7 is a cross-sectional view of the electrical connector assembly taken along line 7-7 of FIG. 1.
Figure 8:
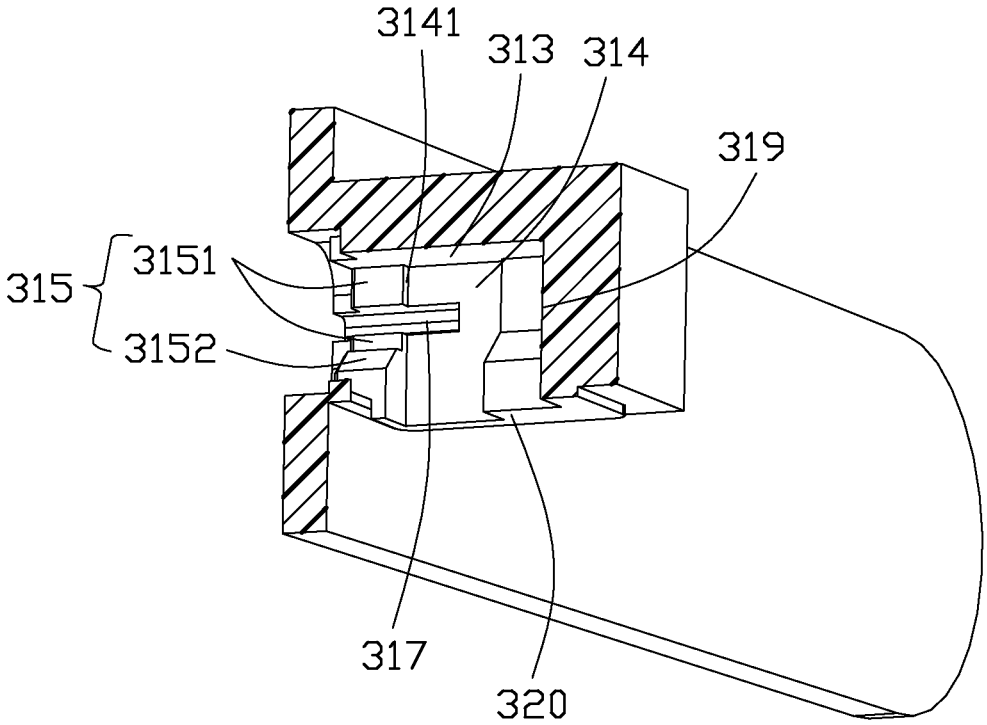
FIG. 8 is a cross-sectional view of the electrical connector assembly taken along line 8-8 of FIG. 1.

Referring to FIG. 4 and FIGS. 7-8, the securing box 3 comprises a box portion 31 for receiving the electrical connector 2 and optionally a plate part 32 connected with the box portion 31. In another embodiment of the present disclosure, the securing box 3 also can be a part of an electronic equipment (not shown). The securing box 3 comprises a top wall 313, a bottom wall 320 faced to the top wall 313, a pair of lateral walls 315 extending downwardly from two sides of the top wall 313 and a rear wall 319 extending downwardly from rear end of the top wall for cooperatively defining a receiving space 311, and an insertion opening 310. The electrical connector 2 is inserted in the receiving space 311 through the insertion opening 310. In accordance with the embodiments of the present disclosure, each lateral wall 315 includes a vertical surface 3151 and an inclined surface 3152. The vertical plate 2231 of the lateral plate 223 contacts with the vertical surface 3151, the inclined plate 2232 of the lateral plate 223 contacts with the inclined surface 3152, the top wall 313 contacts with the top plate 221 of the electrical connector 2, and the rear wall 319 contacts with a rear end of the electrical connector 2. Therefore, the electrical connector 2 is received in the receiving space 311 of the box portion 31 stably.

Referring to FIG. 4 and FIGS. 7-8, the bottom wall 320 defines a through hole 312. The resilient portion 213 of the terminal 21 extends out of the box portion 31 through the through hole 312 for flexibly connecting with the PCB 1. Each lateral wall 315 comprises a locating slot 314 and an extraction slot 317 in communication with the locating slot 314 on an inter surface thereof. The locating slot 314 defines a contacting surface 3141. The contacting surface 3141 is perpendicular to the top plate 221. The extraction slot 317 is shorter than the locating slot 314 along the first direction perpendicular to the top plate 221/top wall 313 and wider than the locating slot 314 along a second direction perpendicular to the vertical surface 3151/lateral wall 315. The resisting portion 2252 resists against the contacting surface 3141 when the electrical connector 2 is fully inserted into the receiving space 311. The extraction slot 317 is used to receive a tool (no shown) for taking out the electrical connector 2.

Figure 5:
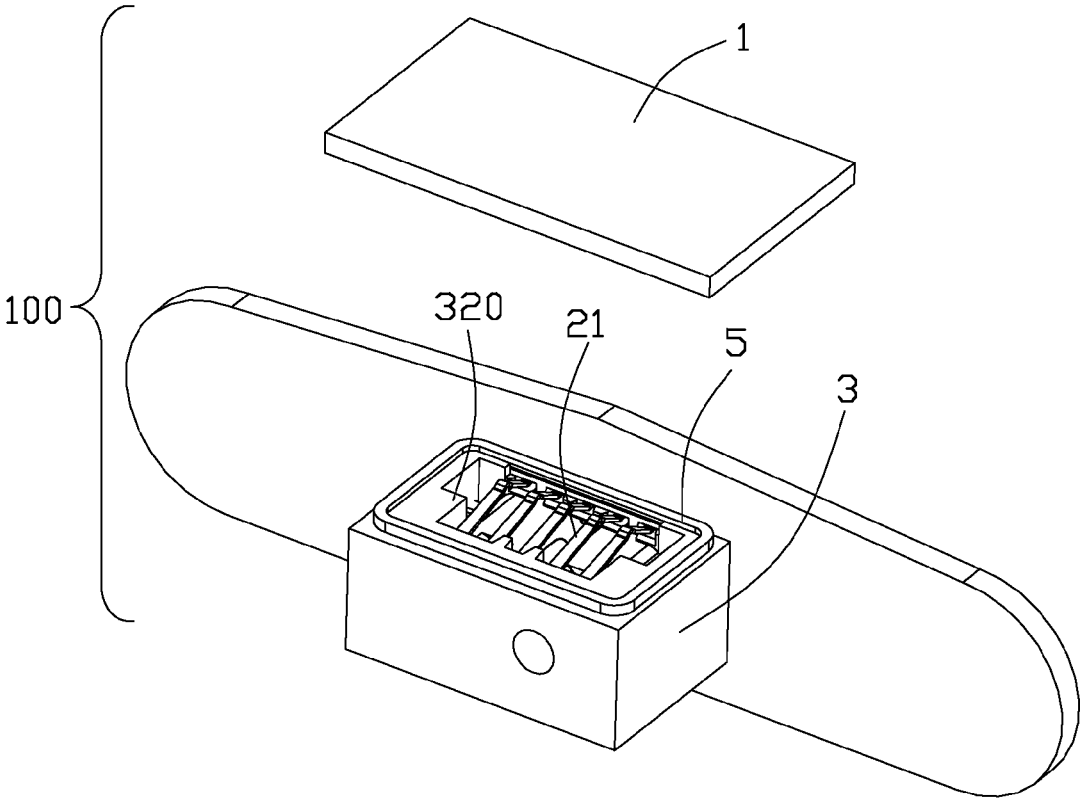
FIG. 5 is a perspective, partly exploded view of the electrical connector assembly taken a same view as FIG. 2, showing the PCB separated from the securing box.
Figure 9:
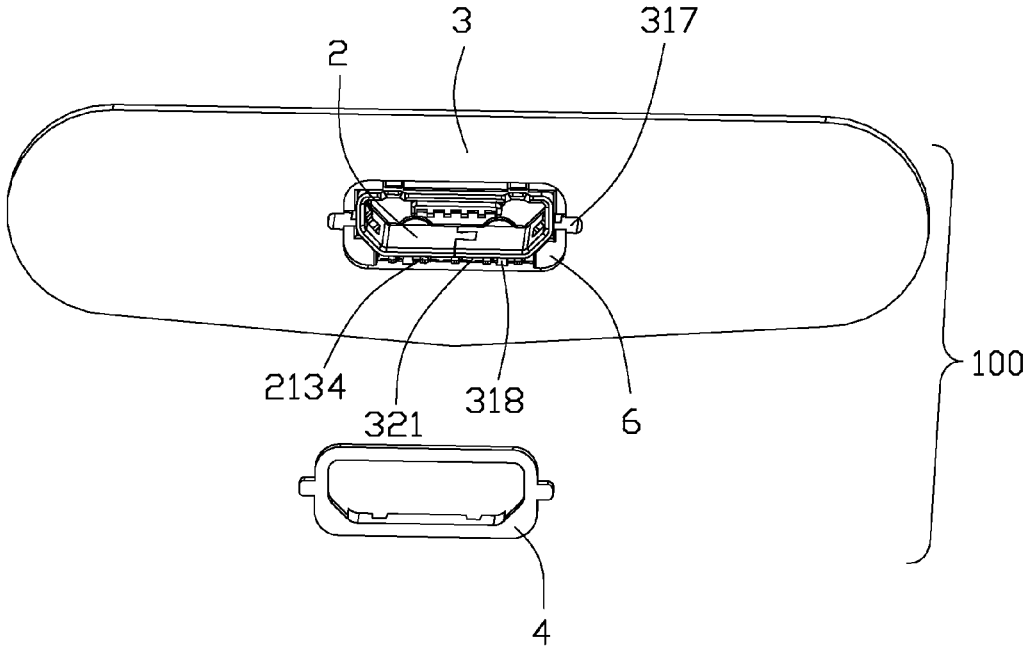
FIG. 9 is a perspective, partly exploded view of the electrical connector assembly taken a same view as FIG. 1, showing the sealing ring separated from the securing box.

Referring to FIGS. 4-5 and FIG. 9, the bottom wall 320 has a preloading wall 316 located at a front end thereof. The preloading wall 316 comprises at least one protrusion 318. The protrusion 318 contacts with the bottom plate 222 when the electrical connector 2 is fully inserted into the receiving space 311 and defines a gap 321 between the bottom plate 222 and the preloading wall 316 for receiving the end portion 2134 of the terminal 21 and the sealing ring 4. The end portion 2134 of the terminal 21 contacts with the preloading wall 316 for taking out the electrical connector 2 easily.

Referring to FIG. 1 and FIG. 4, the sealing ring 4 is made from plastic material such as rubber. The sealing ring 4 comprises a base ring 41 and a pair of ears 42 extending from two sides of the base ring 41. The sealing ring 4 is assembled between the electrical connector 2 and the securing box 3 at the front end of the electrical connector 2 and the ears 42 received in front end of the extraction slot 317 for sealing purpose. The base ring 41 has at least one recess 411 for receiving the protrusion 318. The base ring 41 extends into the gap 321 for preventing the terminal 21 from contacting with the metallic cover 22.

The electrical connector assembly 100 of the present invention comprises the pair of cantilever arms 225, the securing box 3 comprises corresponding the extraction slot 317 and the locating slot 314 for receiving the cantilever arm 225 and therefore, the electrical connector 100 can be easily assembled to or replaced from the PCB because the resilient portion, i.e, the tail section, is not permanently secured to the PCB but in a detachable attachment manner therewith. In an overview aspect, the insulative securing box 3 defines a receiving cavity 311 with an outside opening for communicating to an exterior and an inside opening for communicating with a printed circuit board 1. The electrical connector 2 is received within the receiving cavity 311, including the insulative housing 20 equipped with a plurality of conductive contacts 21 each with a contacting section 211 exposed in a mating cavity which forwardly communicates with the outside opening, and a tail section 213 disposed around the inside opening, the connector being dimensioned smaller than the outside opening for allowing said connector to be withdrawn from the receiving cavity via said outside opening. The securing box 3 includes a forward abutment section (not labeled) around the rear end of the receiving cavity 311 to restrict rearward movement of the connector 2 and a rearward abutment section 3141 around the front side to restrict forward movement of the connector 2. Oppositely, the connector 2 includes a rearward abutting portion (not labeled) around the rear end to abut against the forward abutment section of the securing box, and a forward abutting portion 2252 to abut against the rearward abutment section 3141 of the securing box so as to securing the connector 2 within the receiving cavity 311 in position. In this embodiment, the moveable arm 2251, which is resilient to perform deflection instead of other type movements, is formed on the forward abutting portion 2252 of the connector 2 rather than on the rearward abutment section 3141 of the securing box 3, and is accessibly operable from the exterior to release engagement between the forward abutting portion 2252 of the connector 2 and the rearward abutment section 3141 of the securing box 3 so as to easily withdraw the connector 2 from the receiving cavity 311 of the securing box 3 for replacement of the connector 2, if necessary. It is noted that in this embodiment the cantilevered arm 225 functions as a releasable locking device to assemble the connector 2 within the receiving cavity 311 of the securing box 3 in a detachable attachment manner. It is also noted that the cantilevered arm 225 is not constantly exposed to the exterior but covered by the sealing ring 4 while is still deemed accessible from the exterior once said sealing ring 4 is removed therefrom.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly comprising:

a securing box comprising a box portion, the box portion having an insertion opening and including a top wall, a pair of lateral walls extending downwardly from two sides of the top wall, and a rear wall extending downwardly from a rear end of the top wall, the top, lateral, and rear walls together defining a receiving space, at least one of the two lateral walls including a locating slot on an inner surface thereof and defining a contacting surface; and an electrical connector removably received in the securing box and comprising:

an insulative housing including a base portion and a tongue portion extending from the base portion;

a plurality of terminals retained in the insulative housing, each terminal including a resilient portion extending out of the insulative housing; and a metallic cover covering the insulative housing, the metallic cover including a top plate, an opposite bottom plate, and a pair of lateral plates connected with the top plate and the bottom plate, the metallic cover including at least one cantilever arm extending forwardly and outwardly from the lateral plate, the cantilever arm received in the locating slot and resisting against the contacting surface.

2. The electrical connector assembly as claimed in claim 1, wherein the cantilever arm includes a resilient arm extending forwardly and outwardly from the lateral plate and a resisting portion extending forwardly from the resilient arm, the resisting portion contacts with the contacting surface, and the resisting portion extends further outward than the resilient arm.

3. The electrical connector assembly as claimed in claim 2, wherein the lateral wall includes an extraction slot in communication with the locating slot of the at least one lateral wall, and the extraction slot is shorter than the locating slot along a height direction and wider than the locating slot along a lateral direction.

4. The electrical connector assembly as claimed in claim 3, wherein the resilient portion includes a flat first elastic arm, a flat second elastic arm, and a connecting portion between the first elastic arm and the second elastic arm, the second elastic arm defines a front end portion, the box portion has a preloading wall located at a front end thereof, and the front end portion contacts with the preloading wall.

5. The electrical connector assembly as claimed in claim 4, wherein the preloading wall comprises at least one protrusion, and the at least one protrusion contacts with the bottom plate when the electrical connector is fully inserted into the receiving space.

6. The electrical connector assembly as claimed in claim 5, further including a sealing ring, and wherein a gap is defined between the bottom plate and the preloading wall, the sealing ring being received in the gap.

7. The electrical connector assembly as claimed in claim 6, wherein the sealing ring comprises at least one ear extending from one side thereof and received in a front of the extraction slot.

8. The electrical connector assembly as claimed in claim 1, wherein the box portion includes a bottom wall facing the top wall, the bottom wall defines a through hole, and the resilient portion of the terminal extends out of the box portion through the through hole for connecting to a printed circuit board.

9. The electrical connector assembly as claimed in claim 1, wherein each terminal including a connecting portion fixed in the tongue portion, a retaining portion extending from the connecting portion and fixed in the base portion, and a resilient portion extending from the connecting portion and out of the insulative housing, and the resilient portion faces the connecting portion and is substantially V-shaped.

10. An electrical connector assembly comprising:

an insulative securing box defining a receiving cavity with an outside opening for communicating to an exterior and an inside opening for communicating with a printed circuit board;

an electrical connector received within the receiving cavity including at least one insulative housing equipped with a plurality of conductive contacts each with a contacting section exposed in a mating cavity which forwardly communicates with the outside opening, and a tail section disposed around the inside opening and configured for being not permanently secured to the printed circuit board but in a detachable attachment manner thereto, the connector being dimensioned substantially smaller than the outside opening for allowing said connector to be withdrawn from the receiving cavity via said outside opening; wherein one of the connector and the securing box is equipped with a releasable locking device to removably assemble the connector into the receiving cavity via said outside opening.

11. The electrical connector assembly as claimed in claim 10, wherein said releasable locking device is arranged to be accessibly operable from the exterior.

12. The electrical connector assembly as claimed in claim 10, wherein the securing box is associated with an outside seal around the outside opening for sealing a gap between a metallic shell of the electrical connector and the securing box, and an inside seal around the inside opening for sealing a gap between the printed circuit board and the securing box.

13. The electrical connector assembly as claimed in claim 10, wherein the securing box includes a rearward abutment section to restrict forward movement of the connector, and the connector includes a forward abutting portion to abut against the rearward abutment section of the securing box so as to secure the connector within the receiving cavity in position, and one of the forward abutting portion of the connector and the rearward abutment section of the securing box is equipped with a moveable arm functioning as said releasable locking device and being accessibly operable from the exterior to release engagement between the forward abutting portion of the connector and the rearward abutment section of the securing box so as to easily withdraw the connector from the receiving cavity of the securing box for replacement, if necessary.

14. The electrical connector assembly as claimed in claim 13, wherein said housing includes a mating tongue on which the contacting sections is located, and said connector further includes a metallic shell enclosing the mating tongue and defining a mating cavity, and said moveable arm is formed on the shell.

15. The electrical connector assembly as claimed in claim 14, wherein said securing box includes a slot to accommodate deflection of the moveable arm.

16. A method of removing an electrical connector which communicates with an exterior and a printed circuit board, comprising steps of:

providing an insulative securing box with a receiving cavity and an outside opening for communicating with the exterior and an inside opening for communicating with the printed circuit board;

providing the connector located within the receiving cavity and equipped with a mating tongue and a plurality of contacts each having a contacting section exposed upon the mating tongue and a tail section located around the inside opening for being not permanently secured to but electrically and mechanically contacting the printed circuit board, wherein said connector is dimensioned substantially smaller than the outside opening so as to easily withdraw the connector from the receiving cavity of the securing box via said outside opening; and providing one of said connector and said securing box with a releasable locking device which is accessibly operable from the exterior so as to removably assemble the connector into the receiving cavity for operation or withdraw the connector from the receiving cavity for repairing.

17. The method as claimed in claim 16, further comprising steps of providing a rearward abutment section around a periphery of the receiving cavity and providing the connector with a forward abutting portion abutting against said rearward abutment section for preventing forward movement of the connector relative to the securing box, and providing one of said rearward abutment section and said forward abutting portion with a moveable arm functioning as said releasable locking device so as to disengage the forward abutting portion from the rearward abutment section for withdrawing the connector from the receiving cavity of the securing box.

18. The method as claimed in claim 17, further providing a metallic shell located between the securing box and the mating tongue and essentially surrounding the mating tongue.

19. The method as claimed in claim 18, wherein the connector includes an insulative housing forming said mating tongue, said shell is a part of the connector and is permanently assembled with said insulative housing, and the forward abutting portion is formed on the shell.

20. The method as claimed in claim 18, wherein said moveable arm is formed on the shell.

* * * * *